US010251806B2

(12) United States Patent
Paterson et al.

(10) Patent No.: US 10,251,806 B2
(45) Date of Patent: Apr. 9, 2019

(54) COLLAPSIBLE ROLLING WALKER

(71) Applicant: Medline Industries Inc., Northfield, IL (US)

(72) Inventors: Michael Paterson, Chicago, IL (US); Tong Jin Kim, West Lafayette, IN (US); Kegan McDaniel, Chicago, IL (US); Luke Westra, Chicago, IL (US)

(73) Assignee: Medline Industries, Inc., Northfield, IL (US)

( * ) Notice: Subject to any disclaimer, the term of this patent is extended or adjusted under 35 U.S.C. 154(b) by 0 days.

(21) Appl. No.: 15/706,926

(22) Filed: Sep. 18, 2017

(65) Prior Publication Data

US 2018/0021204 A1 Jan. 25, 2018

Related U.S. Application Data

(63) Continuation of application No. 15/095,854, filed on Apr. 11, 2016, now Pat. No. 9,763,849.

(60) Provisional application No. 62/145,356, filed on Apr. 9, 2015.

(51) Int. Cl.
*A61H 3/04* (2006.01)
*A61H 3/00* (2006.01)

(52) U.S. Cl.
CPC ..... *A61H 3/04* (2013.01); *A61H 2003/002* (2013.01); *A61H 2003/046* (2013.01); *A61H 2201/0157* (2013.01); *A61H 2201/0161* (2013.01); *A61H 2201/1633* (2013.01)

(58) Field of Classification Search
CPC ..... A61H 3/04; A61H 2003/043; A61H 2003/046; A61H 2003/02; A61H 2201/0157; A61H 2201/0161; A61H 2201/1633; A61H 2003/002
USPC ..... 280/639, 657, 38, 42
See application file for complete search history.

(56) References Cited

U.S. PATENT DOCUMENTS

| | | | |
|---|---|---|---|
| 474,666 | A | 5/1892 | Krehbiel |
| 3,186,759 | A | 6/1965 | Reeves |
| 3,338,628 | A | 8/1967 | Evans |
| 4,211,309 | A | 7/1980 | Ruggiero |
| 4,229,039 | A | 10/1980 | Day |
| 4,341,381 | A | 7/1982 | Norberg |
| D281,771 | S | 12/1985 | Webb |
| D289,507 | S | 4/1987 | Danielsson |
| 5,058,912 | A | 10/1991 | Harroun |
| 5,060,967 | A | 10/1991 | Hulterstrum |
| 5,224,731 | A | 7/1993 | Johnson |
| 5,320,122 | A | 6/1994 | Jacobson, II |

(Continued)

FOREIGN PATENT DOCUMENTS

| | | |
|---|---|---|
| DE | 29717488 | 11/1997 |
| EP | 2343035 | 8/2012 |

(Continued)

OTHER PUBLICATIONS

Australian Office Action from Australian Patent Application No. 2013341540 dated Feb. 10, 2017.

(Continued)

*Primary Examiner* — John D Walters
(74) *Attorney, Agent, or Firm* — Fitch, Even, Tabin & Flannery LLP

(57) ABSTRACT

A collapsible rolling walker that readily collapses for storage and/or transportation and that readily deploys for use.

16 Claims, 15 Drawing Sheets

(56) References Cited

U.S. PATENT DOCUMENTS

| | | | | |
|---|---|---|---|---|
| 5,364,120 | A | 11/1994 | Shimansky | |
| 5,419,571 | A | 5/1995 | Vaughan | |
| D360,174 | S | 7/1995 | Kjell | |
| D367,833 | S | 3/1996 | Ahlbertz | |
| D372,890 | S | 8/1996 | Ferm | |
| 5,716,063 | A * | 2/1998 | Doyle | A61H 3/04 135/67 |
| 5,741,020 | A | 4/1998 | Harroun | |
| 5,772,234 | A | 6/1998 | Luo | |
| D396,437 | S | 7/1998 | Liljedahl | |
| 5,904,168 | A | 5/1999 | Alulyan | |
| 6,338,493 | B1 | 1/2002 | Wohlgemuth | |
| 6,378,883 | B1 | 4/2002 | Epstein | |
| D503,909 | S | 4/2005 | Tolfsen | |
| D519,423 | S | 4/2006 | Tolfsen | |
| 7,192,043 | B1 | 3/2007 | McLuen | |
| 7,219,906 | B2 | 5/2007 | Hallgrimsson | |
| 7,306,246 | B2 * | 12/2007 | Gale | A61H 3/04 280/47.34 |
| D560,563 | S | 1/2008 | Fransson | |
| 7,370,734 | B2 | 5/2008 | Hallgrimsson | |
| 7,379,734 | B2 | 5/2008 | Sato | |
| 7,484,740 | B2 | 2/2009 | Miller | |
| 7,628,411 | B2 | 12/2009 | Meyers | |
| D623,992 | S | 9/2010 | Derks | |
| D633,830 | S | 3/2011 | Derks | |
| 7,918,473 | B2 | 4/2011 | Yao | |
| 8,083,240 | B2 | 12/2011 | Jacobs | |
| 8,226,111 | B2 * | 7/2012 | Valdez | B62B 7/062 280/647 |
| 8,596,669 | B2 | 12/2013 | Liao | |
| 8,646,804 | B2 | 2/2014 | Derks | |
| 8,851,502 | B2 | 10/2014 | Gaudiano | |
| 8,936,262 | B2 | 1/2015 | Nabeta | |
| 8,979,114 | B2 | 3/2015 | Cheng | |
| 8,998,222 | B2 | 4/2015 | Huang | |
| 8,998,223 | B2 | 4/2015 | Chang | |
| D736,121 | S | 8/2015 | Wang | |
| D739,314 | S | 9/2015 | Wang | |
| 9,173,802 | B2 | 11/2015 | Willis | |
| 9,226,868 | B2 | 1/2016 | Andersen | |
| D754,034 | S | 4/2016 | Wang | |
| D754,568 | S | 4/2016 | Wang | |
| 9,381,132 | B2 | 7/2016 | Chen | |
| D766,139 | S | 9/2016 | Chen | |
| 9,687,411 | B2 | 6/2017 | Chen | |
| D795,752 | S | 8/2017 | Wang | |
| D795,753 | S | 8/2017 | Wang | |
| 9,763,849 | B2 | 9/2017 | Paterson | |
| 9,839,571 | B2 | 12/2017 | Pan | |
| 9,877,889 | B2 | 1/2018 | Chen | |
| 9,907,723 | B2 | 3/2018 | Bisceglia | |
| 9,968,509 | B2 | 5/2018 | Andersen | |
| 9,974,708 | B1 | 5/2018 | Janeczek | |
| 2002/0050697 | A1 | 5/2002 | Hallgrimsson | |
| 2002/0079663 | A1 | 6/2002 | Hallgrimsson | |
| 2002/0153684 | A1 | 10/2002 | Sung | |
| 2004/0079405 | A1 | 4/2004 | Sanders | |
| 2004/0104559 | A1 | 6/2004 | Chen | |
| 2004/0118640 | A1 | 6/2004 | Hallgrimsson | |
| 2004/0245737 | A1 | 12/2004 | Hallgrimsson | |
| 2005/0001398 | A1 | 1/2005 | Serhan | |
| 2006/0284040 | A1 | 12/2006 | Nixon | |
| 2007/0034243 | A1 | 2/2007 | Miller | |
| 2007/0170699 | A1 | 7/2007 | Li | |
| 2007/0235067 | A1 | 10/2007 | Gale | |
| 2007/0267054 | A1 | 11/2007 | Meyers | |
| 2007/0283990 | A1 | 12/2007 | Fernandez | |
| 2008/0111349 | A1 | 5/2008 | Willis | |
| 2008/0129016 | A1 | 6/2008 | Willis | |
| 2008/0135077 | A1 | 6/2008 | Meyers | |
| 2008/0202571 | A1 | 8/2008 | Meyers | |
| 2008/0252043 | A1 | 10/2008 | Willis | |
| 2009/0033052 | A1 | 2/2009 | Bradshaw | |
| 2010/0301574 | A1 | 12/2010 | Derks | |
| 2012/0205882 | A1 | 8/2012 | Staggs | |
| 2013/0113187 | A1 | 5/2013 | Willis | |
| 2013/0292916 | A1 | 11/2013 | Nabeta | |
| 2013/0320640 | A1 | 12/2013 | Liu | |
| 2014/0084559 | A1 | 3/2014 | Fang | |
| 2014/0125037 | A1 * | 5/2014 | Andersen | A61H 3/04 280/639 |
| 2015/0182394 | A1 | 7/2015 | Kutsch | |
| 2016/0113833 | A1 | 4/2016 | Andersen | |

FOREIGN PATENT DOCUMENTS

| | | |
|---|---|---|
| JP | D1148308 | 7/2002 |
| JP | D1292289 | 1/2007 |
| TW | D107853 | 11/2005 |
| TW | D127741 | 3/2009 |

OTHER PUBLICATIONS

Chinese Office Action from Chinese Patent Application No. 201310547406.7 dated Sep. 2, 2016 with English translation.

Copenheaver, Blaine R.; Authorized Officer; International Search Report and Written Opinion from related International Application No. PCT/US2016/026936; dated Jul. 6, 2016; 14 pages.

Extended European Search Report from European Patent Application No. 13853894.7 dated Jun. 17, 2016.

PCT Patent Application No. PCT/US2013/068116; International Search Report and Written Opinion dated Feb. 13, 2014.

Taiwanese Search Report from TW102303182 dated Jul. 17, 2014.

"Adjustable Rollator by Patterson Medical", Medline product currently available at https://www.medline.com/product/Adjustable-Rollator-by-Patterson-Medical/Rollators/Z05-PF55372?question=rollator&index=P35&indexCount=35, believed to be publicly available at least before Oct. 13, 2016.

"Bariatric RollAider™ by Patterson Medical", Medline product currently available at https://www.medline.com/product/Bariatric-RollAider153-by-Patterson-Medical/Rollators/Z05-PF74285?question=rollator&index=P43&indexCount=43, believed to be publicly available at least before Oct. 13, 2016.

"Basic Rollators", Medline product currently available at https://www.medline.com/product/Basic-Rollators/Rollators/Z05-PF04832?question=rollator&index=P4&indexCount=4, believed to be publicly available at least before Oct. 13, 2016.

"Basic Steel Rollators", Medline product currently available at https://www.medline.com/product/Basic-Steel-Rollators/Rollators/Z05-PF61071?question=rollator&index=P10&indexCount=10, believed to be publicly available at least before Oct. 13, 2016.

"Deluxe Comfort Rollators", Medline product currently available at https://www.medline.com/product/Deluxe-Comfort-Rollators/Rollators/Z05-PF61367?question=rollator&index=P8&indexCount=8, believed to be publicly available at least before Oct. 13, 2016.

"Deluxe Rollators", Medline product currently available at https://www.medline.com/product/Deluxe-Rollators/Rollators/Z05-PF04834?question=rollator&index=P6&indexCount=6, believed to be publicly available at least before Oct. 13, 2016.

"Empower Rollator", Medline product currently available at https://www.medline.com/product/Empower-Rollator/Rollators/Z05-PF75510?question=rollator&index=P11&indexCount=11, believed to be publicly available at least before Oct. 13, 2016.

"Guardian Deluxe Rollators with 8" Wheels", Medline product currently available at https://www.medline.com/product/Guardian-Deluxe-Rollators-with-8-Wheels/Rollators/Z05-PF04840?question=rollator&index=P1&indexCount=1#mrkSpec, believed to be publicly available at least before Oct. 13, 2016.

"Guardian Economy Rollators", Medline product currently available at https://www.medline.com/product/Guardian-Economy-Rollators/Rollators/Z05-PF04841?question=rollator&index=P9&indexCount=9, believed to be publicly available at least before Oct. 13, 2016.

"Invacare® Rollite™ Rollator by Patterson Medical", Medline product currently available at https://www.medline.com/product/Invacare-Rollite153-Rollator-by-Patterson-Medical/Rollators/Z05-

(56) References Cited

OTHER PUBLICATIONS

PF59721?question=rollator&index=P37&indexCount=37, believed to be publicly available at least before Oct. 13, 2016.
"Light Weight Extra Wide Heavy-Duty Alumi", Medline product currently available at https://www.medline.com/product/Light-Weight-Extra-Wide-Heavy-Duty-Alumi/Rollators/Z05-PF55515?question=rollator&index=P41&indexCount=41, believed to be publicly available at least before Oct. 13, 2016.
"Luxe Rollator", Medline product currently available at https://www.medline.com/product/Luxe-Rollator/Rollators/Z05-PF04842?question=rollator&index=P7&indexCount=7, believed to be publicly available at least before Oct. 13, 2016.
"Posh Pink Zebra Rollator", Medline product currently available at https://www.medline.com/product/Posh-Pink-Zebra-Rollator/Rollators/Z05-PF70685?question=rollator&index=P21&indexCount=21, believed to be publicly available at least before Oct. 13, 2016.
"Rollators with 8" Wheels", Medline product currently available at https://www.medline.com/product/Rollators-with-8-Wheels/Rollators/Z05-PF04844?question=rollator&index=P2&indexCount=2, believed to be publicly available at least before Oct. 13, 2016.
"Set n' Go Height Adjustable Rollator by Graham-Field", Medline product currently available at https://www.medline.com/product/Set-n-Go-Height-Adjustable-Rollator-by-Graham-Field/Rollators/Z05-PF110256?question=rollator&index=P29&indexCount=29, believed to be publicly available at least before Oct. 13, 2016.
"Simplicity Rollator", Medline product currently available at https://www.medline.com/product/Simplicity-Rollator/Rollators/Z05-PF71394?question=rollator&index=P12&indexCount=12c, believed to be publicly available at least before Oct. 13, 2016.
"Standard Bariatric Heavy Duty Rollator", Medline product currently available at https://www.medline.com/product/Standard-Bariatric-Heavy-Duty-Rollator/Rollators/Z05-PF04829?question=rollator&index=P3&indexCount=3, believed to be publicly available at least before Oct. 13, 2016.
"Stealth Rollator", Medline product currently available at https://www.medline.com/product/Stealth-Rollator/Rollators/Z05-PF71395?question=rollator&index=P19&indexCount=19, believed to be publicly available at least before Oct. 13, 2016.
"Tri-Wheeled Rollators", Medline product currently available at https://www.medline.com/product/Tri-Wheeled-Rollators/Rollators/Z05-PF04845?question=rollator&index=P16&indexCount=16, believed to be publicly available at least before Oct. 13, 2016.
"U-Step Walking Stabilizer by Alimed", Medline product currently available at https://www.medline.com/product/U-Step-Walking-Stabilizer-by-Alimed/Rollators/Z05-PF57847?question=rollator&index=P48&indexCount=48, believed to be publicly available at least before Oct. 13, 2016.
"Ultralight Rollators", Medline product currently available at https://www.medline.com/product/Ultralight-Rollators/Rollators/Z05-PF04838?question=rollator&index=P5&indexCount=5, believed to be publicly available at least before Oct. 13, 2016.
"Walker CarryOn! Bags by Patterson", Medline product curretnly available at https://www.medline.com/product/Walker-CarryOn-Bags-by-Patterson-Medical/Parts-Accessories/Z05-PF58535?P19&indexCount=19, believed to be publicly available at least before Oct. 13, 2016.
"Width Adjustable Rollators", Medline product currently available at https://www.medline.com/product/Width-Adjustable-Rollators/Rollators/Z05-PF103010?question=rollator&index=P18&indexCount=18, believed to be publicly available at least before Oct. 13, 2016.
"Winnie Mimi Lite-RollatorTransport Cha", Medline product currently available at https://www.medline.com/product/Winnie-Mimi-Lite-Rollator-Transport-Cha/Rollators/Z05-PF43257?question=rollator&index=P53&indexCount=53, believed to be publicly available at least before Oct. 13, 2016.

* cited by examiner

COLLAPSIBLE ROLLING WALKER

CROSS-REFERENCE TO RELATED APPLICATIONS

This application is a continuation of prior U.S. patent application Ser. No. 15/095,854, filed Apr. 11, 2016 which claims the benefit of U.S. Provisional Application No. 62/145,356, filed Apr. 9, 2015, which are all incorporated herein by reference in their entirety.

TECHNICAL FIELD

These teachings relate generally to rolling walkers.

BACKGROUND

Wheelchairs are typically designed to transport a sitting person and so-called companion chairs are a lighter-duty mechanism having a similar operating purpose. Accordingly, both wheelchairs and companion chairs typically have leg riggings to support the transportee's lower appendages above the ground. By way of contrast, rolling walkers are a walking aid and hence lack such leg riggings. That said, some rolling walkers include a seat. This seat provides the user with a place to sit when that need arises (for example, when the user needs a break from standing or walking).

The basic design for a rolling walker is well established; a frame having four ground-contacting wheels and a pair of handles that the user can grip when walking with the aid of the rolling walker. Unfortunately, these deceptively simple design concepts are not always implemented in a fashion that well suits the needs of the expected user population. The rolling walker user population represents a wide variety of usage patterns, lifestyles, differently-sized and proportioned users, and operating environments. Some users, for example, may only utilize their rollator on an occasional basis while other users may need to frequently transport their rollators in a vehicle and more aggressively use their rollators in a variety of application settings.

BRIEF DESCRIPTION OF THE DRAWINGS

The above needs are at least partially met through provision of the collapsible rolling walker described in the following detailed description, particularly when studied in conjunction with the drawings, wherein.

Figure 1:
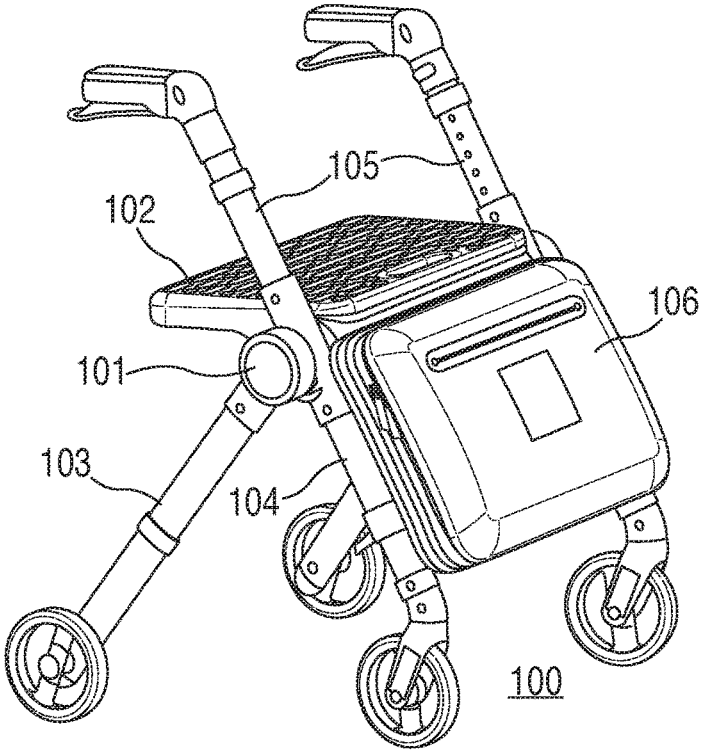
FIG. 1 comprises a perspective view as configured in accordance with various embodiments of these teachings.
Figure 2:
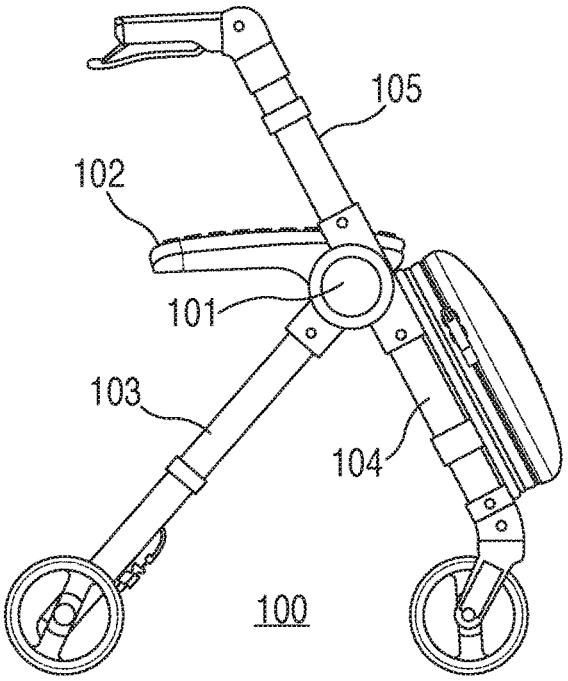
FIG. 2 comprises a side elevational view as configured in accordance with various embodiments of these teachings.
Figure 3:
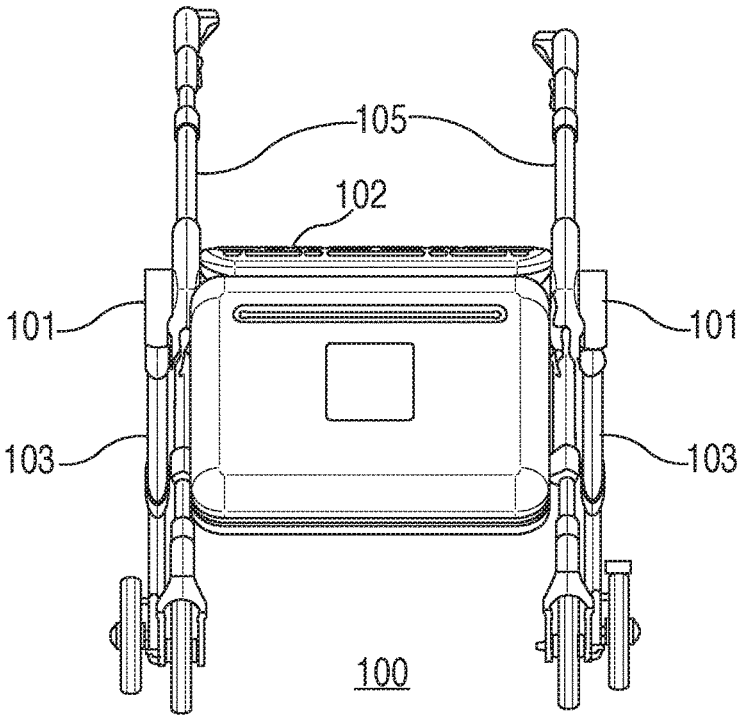
FIG. 3 comprises a front elevational view as configured in accordance with various embodiments of these teachings.
Figure 4:
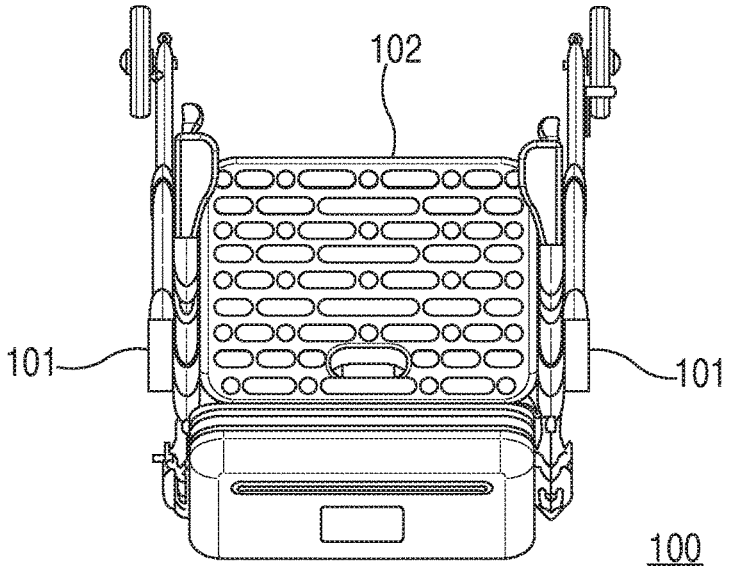
FIG. 4 comprises a top plan view as configured in accordance with various embodiments of these teachings.
Figure 5:
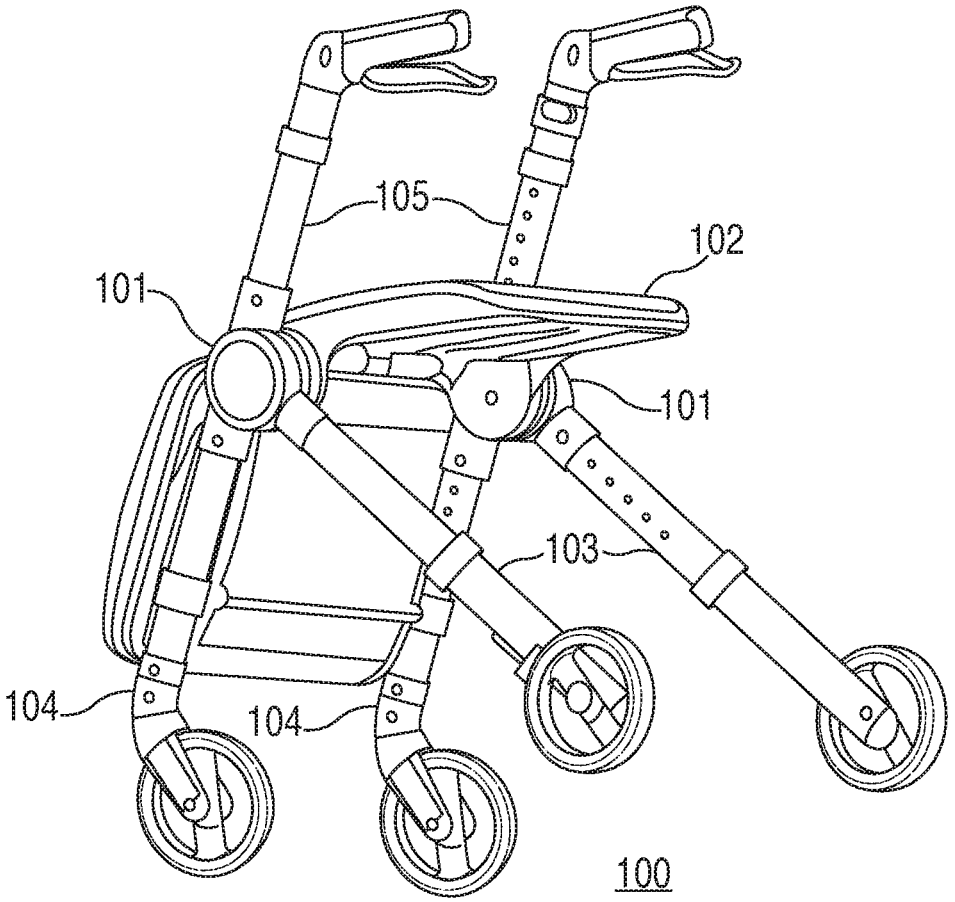
FIG. 5 comprises a bottom perspective view as configured in accordance with various embodiments of these teachings.

Elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present teachings. Also, common but well-understood elements that are useful or necessary in a commercially feasible embodiment are often not depicted in order to facilitate a less obstructed view of these various embodiments of the present teachings. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to these various embodiments a collapsible rolling walker is readily collapsed for storage and/or transportation and readily deployed for use.

These and other benefits may become clearer upon making a thorough review and study of the following detailed description. Referring now to the drawings, FIGS. 1-5 generally depict various views of a rolling walker 100 that accords with these teachings.

In this illustrative example the rolling walker 100 includes a pair of hubs 101 disposed on either side of a seat assembly 102. A wheel-bearing front leg 104 securely attaches to each hub 101 while a wheel-bearing rear leg 103 and handle arm 105 are pivotally attached to each hub 101 and hence can rotate with respect to the wheel-bearing front leg 104. As will be described in more detail herein, each hub 101 is itself comprised of three sub-hubs, with each of the front leg 104, rear leg 103, and handle arm 105 being secured to a separate one of the sub-hubs.

The rear legs 103 and handle arms 105 are configured to selectively assume a fully-deployed position as illustrated. In this example, when fully deployed the front leg 104 and handle arm 105 on each side of the rolling walker 100 are co-linear and are axially aligned with one another. When fully deployed as illustrated, the rolling walker 100 can be utilized in an ordinary manner.

Figure 7:
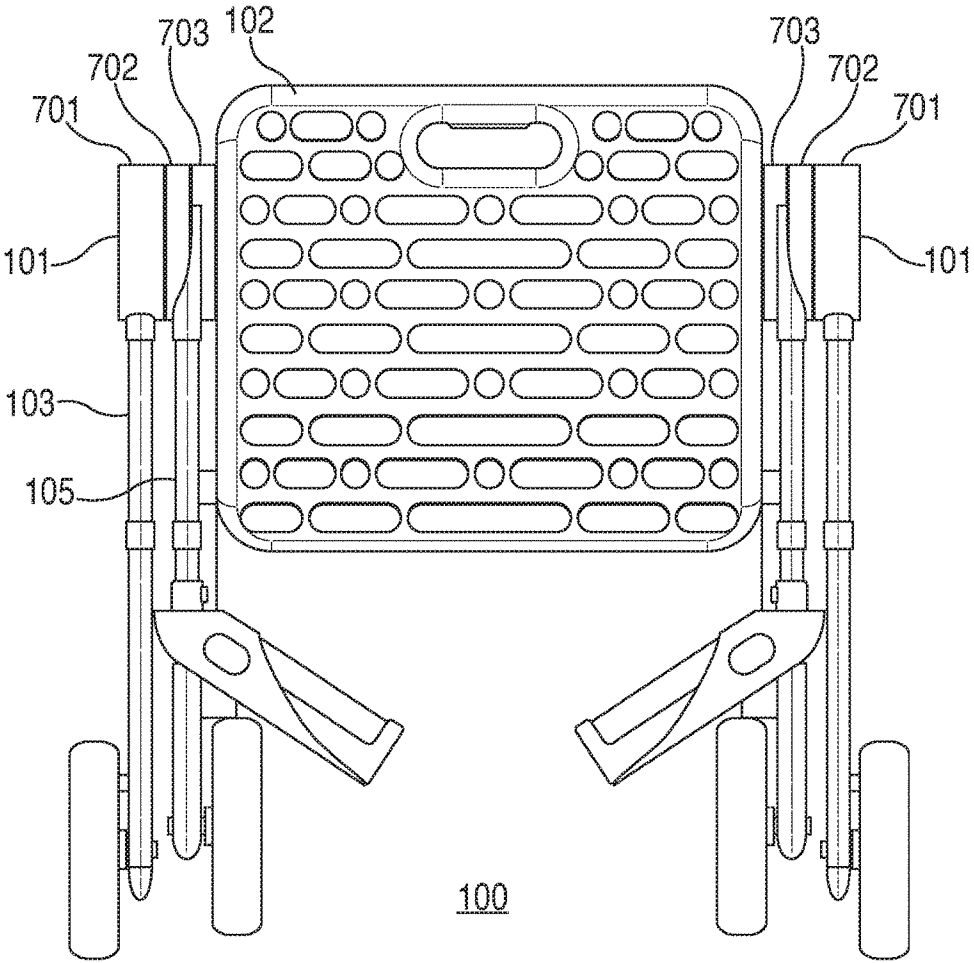
FIG. 7 comprises a front elevational view of the rolling walker in a fully collapsed state as configured in accordance with various embodiments of the invention.
Figure 6:
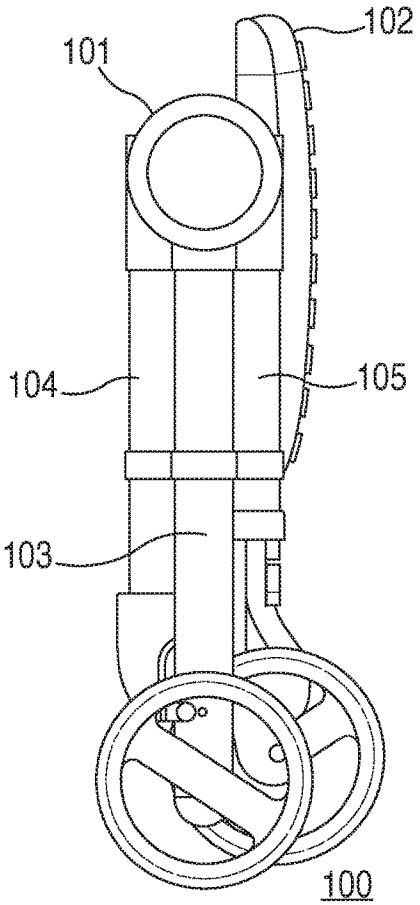
FIG. 6 comprises a side elevational view of the rolling walker in a fully-collapsed state as configured in accordance with various embodiments of these teachings.
Figure 8:
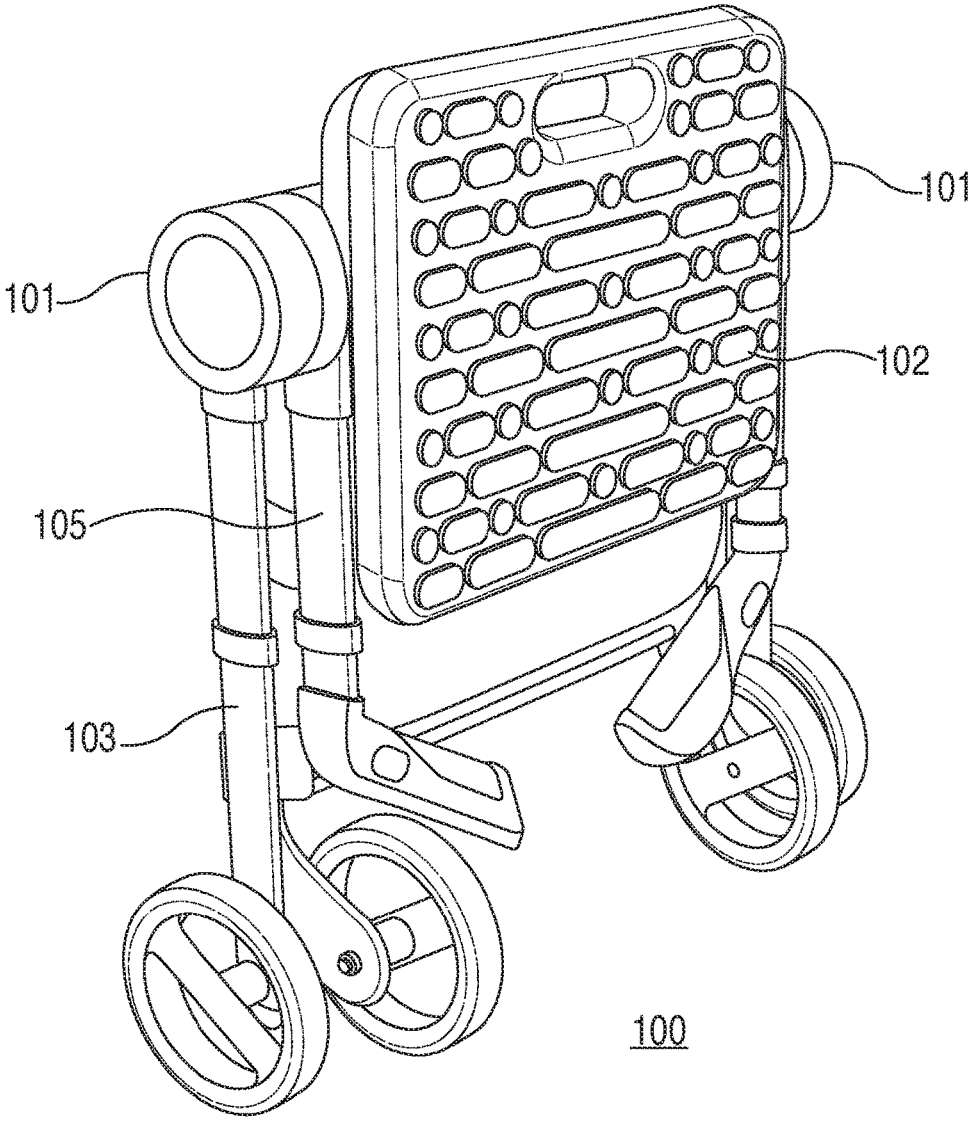
FIG. 8 comprises a perspective view of the rolling walker in a fully collapsed state as configured in accordance with various embodiments of these teachings.
Figure 9:
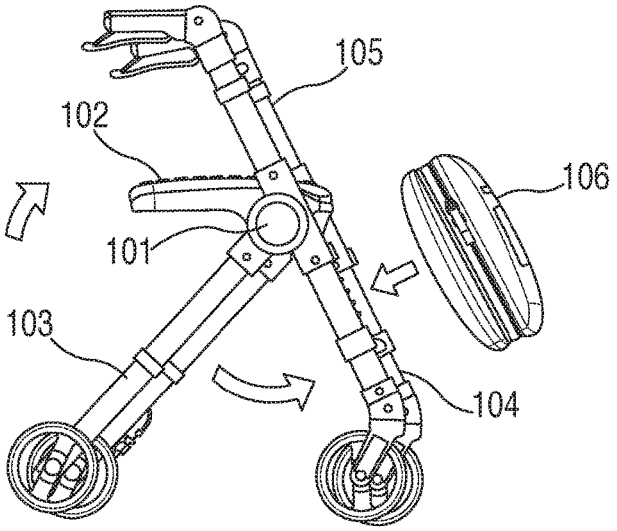
FIG. 9 comprises a side elevational view as configured in accordance with various embodiments of the invention.

As noted, the front leg 104 and handle arm 105 can selectively pivot with respect to their corresponding hub 101. Referring momentarily to FIGS. 6-8, this pivoting capability permits the front legs 104 and handle arms 105 to assume a non-deployed orientation comprising a fully-collapsed state for the rolling walker 100. When collapsed the rolling walker 100 requires very little space and can be readily stored or transported as desired. As illustrated in FIG. 9, the rolling walker 100 can assume the fully-deployed configuration by pivoting the front legs 104 outwardly and away from the rear legs 103 and by pivoting the handle arms 105 upwardly and away from the rear legs 103. Other features that support and/or leverage this collapsing capability of the rolling walker 100 are described herein.

By one approach, and as shown in these illustrations, the front leg 104, rear leg 103, and handle arm 105 on either side of the rolling walker 100 are all aligned at least substantially in parallel with one another when fully collapsed (i.e., at least within 5 degrees of one another, though being aligned at least within 1 or 2 degrees of one another can produce a typically more favorable result). These teachings will accommodate other possibilities in these regards. Generally speaking, however, the illustrated approach will often times be beneficial by requiring a least amount of space to accommodate the fully-collapsed configuration.

Figure 10:
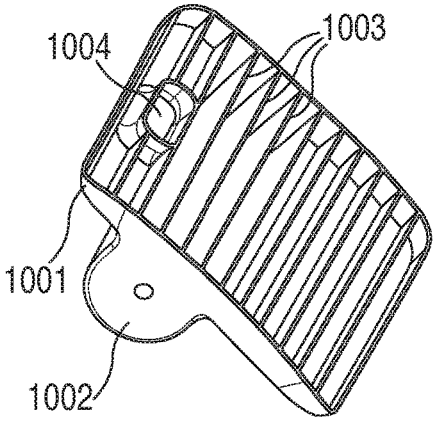
FIG. 10 comprises a perspective view as configured in accordance with various embodiments of these teachings.
Figure 11:
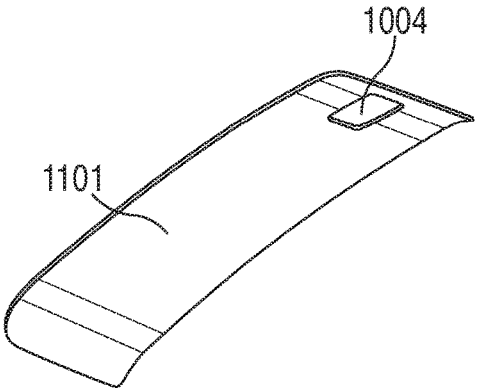
FIG. 11 comprises a perspective view as configured in accordance with various embodiments of these teachings.
Figure 12:
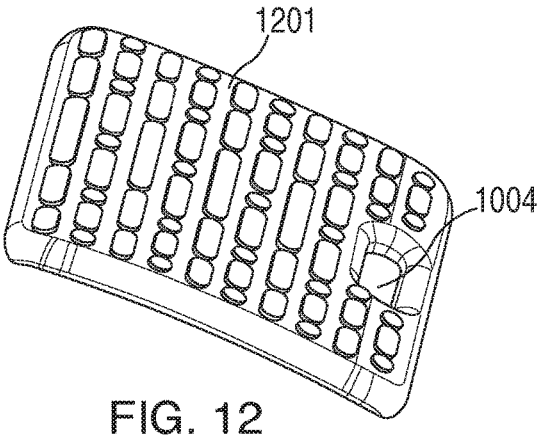
FIG. 12 comprises a perspective view as configured in accordance with various embodiments of these teachings.

As noted above, the seat assembly 102 is disposed between the hubs 101. Referring to FIGS. 10-12, in this illustrative example the seat assembly 102 is comprised of three separate molded plastic components comprising a bottom portion 1001, an inner portion 1101, and an upper portion 1201. The bottom portion 1001 includes flanges 1002 that comprise a part of the aforementioned hub 101. For strength, the bottom portion 1001 includes a plurality of ribs 1003 integrally disposed therein. The upper portion 1201 has a textured surface to help prevent a seated person from slipping off the seat assembly 102 and also to help retain objects that are placed thereon. In this particular example the "texture" is provided via a series of low profile raised areas. Some of these areas have a different upper surface area then others of these areas. These varying sizes may contribute to improved gripping action and also provides an aesthetically pleasing result.

Figure 31:
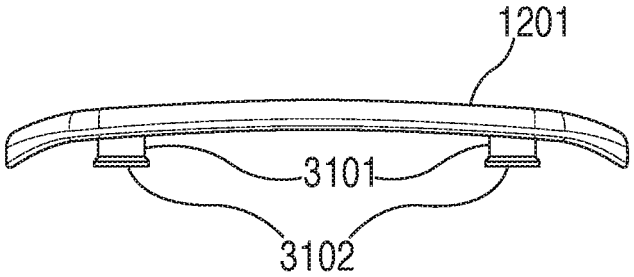
FIG. 31 comprises a front elevational view as configured in accordance with various embodiments of these teachings.

If desired, and referring momentarily to FIG. 31, the upper portion 1201 may comprise a discrete upper portion that includes, on its underside, a plurality (such as four) of rods 3101 that extend perpendicularly outwardly and downwardly and that are sized and configured to be received within holes that are formed in a remaining portion of the seat assembly. In this particular example each of these rods 3101 has an end portion comprising a circumferentially-enlarged portion 3102 that serves to captivate the rods 3101 within the aforementioned holes to thereby retain this upper portion 1201 in an installed configuration. Using this approach a variety of different upper portions can be made available to suit various preferences or requirements including upper portions made of different materials and/or different seating configurations.

Being comprised of molded plastic, the seat assembly 102 is both lighter than typical prior art results and considerably more weatherproof than prior art achievements in these regards.

Figure 13:
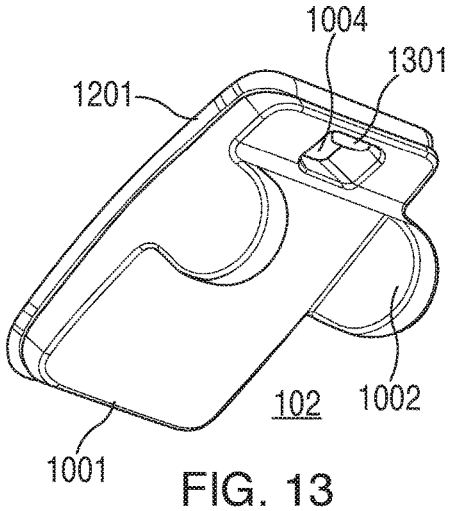
FIG. 13 comprises a perspective view as configured in accordance with various embodiments of these teachings.

Each of the components that comprise the seat assembly 102 has a hole 1004 formed therethrough. When fully assembled as shown in FIG. 13, these holes 1004 are aligned with one another and collectively form a handle. A person can use this handle to readily carry the collapsed rolling walker 100. This handle can also be utilized when unfolding the rolling walker 100 from the fully-collapsed state to the fully-deployed state. To further support such functionality, in this example this handle area includes a latch trigger 1301. This latch trigger 1301 operably couples to a latch mechanism within the hub 101 that permits the aforementioned pivoting movement of the front legs 104 and the handle arms 105.

By one approach the aforementioned components are coupled to one another without any particular internal biasing towards a deployed configuration. Instead, to deploy these components the user asserts the aforementioned latch trigger 1301 which releases the front legs 104 and the handle arms 105. A relatively simple movement and/or manipulation of the rolling walker 100 at this point (typically while suspended above the ground) will encourage these components to pivot around to their deployed positions.

FIGS. 21 through 27 provide a more specific example in these regards. It shall be understood that the details of this example are intended to serve an illustrative purpose and are not intended to suggest any particular limitations in these regards.

Figure 21:
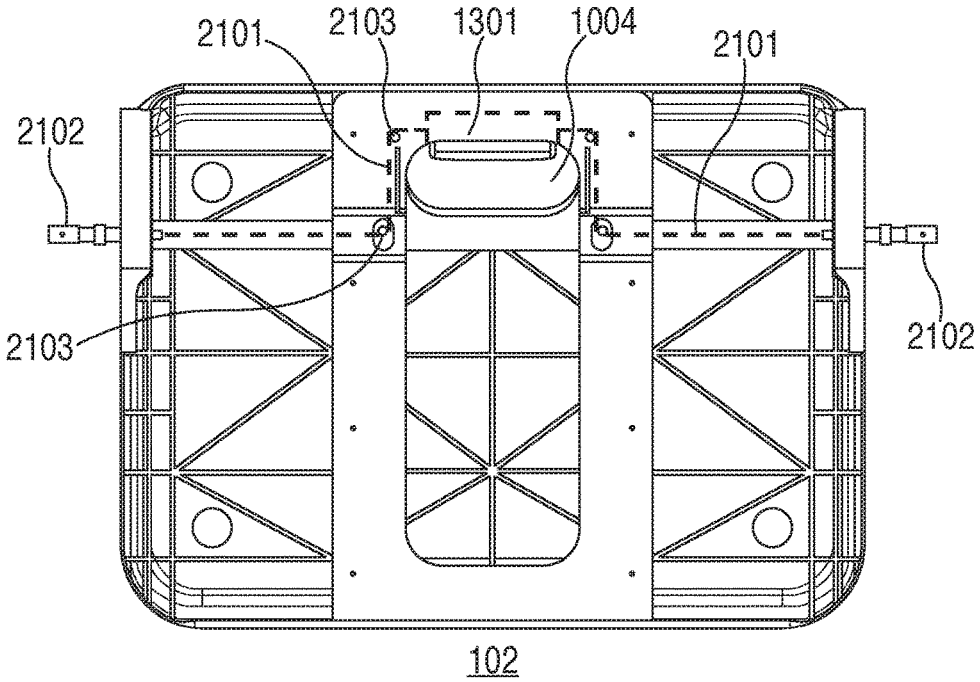
FIG. 21 comprises a bottom plan view as configured in accordance with various embodiments of these teachings.

FIG. 21 presents a view of the underside of the seat assembly 102. In this example the aforementioned latch trigger 1301 is normally biased inwardly towards the aforementioned hole 1004 in the seat assembly by one or more springs or the like (not shown). This latch trigger 1301 connects to and controls a first and second latch mechanism on opposing sides of the seat assembly 102. In this illustrative example these latch mechanisms include a cable 2101 that connects to the latch trigger 1301 at one end and to a longitudinal member 2102 at the opposite end thereof. Each of the cables 2101 operates in conjunction with at least a pair of rollers 2103 that help to guide the corresponding cable 2101.

Figure 22:
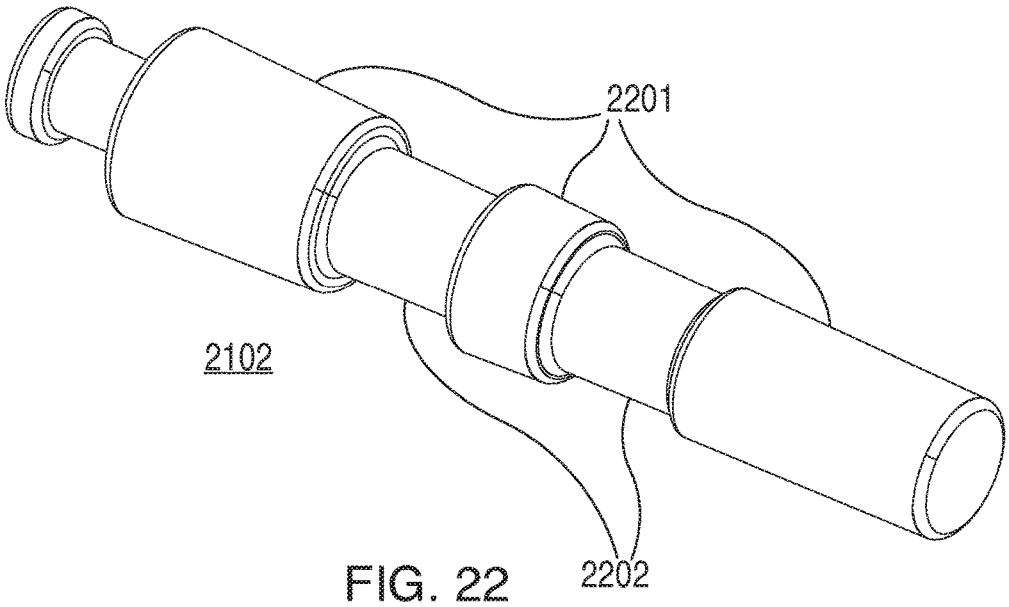
FIG. 22 comprises a perspective view as configured in accordance with various embodiments of these teachings.

The aforementioned longitudinal member 2102 can be comprised of a strong material such as a suitable metal. Referring to FIG. 22 as well, the longitudinal member 2102 in this example has a circular cross section. It will be noted that at least three portions of the longitudinal member 2102 have a relatively wider diameter and hence comprise wider-diameter areas 2201. By contrast, at least two portions of the longitudinal member 2102 have a relatively smaller diameter and hence comprise smaller-diameter areas 2202. The purpose and scope of these wider-diameter areas 2201 and smaller-diameter areas 2202 is described in more detail further below.

Figure 23:
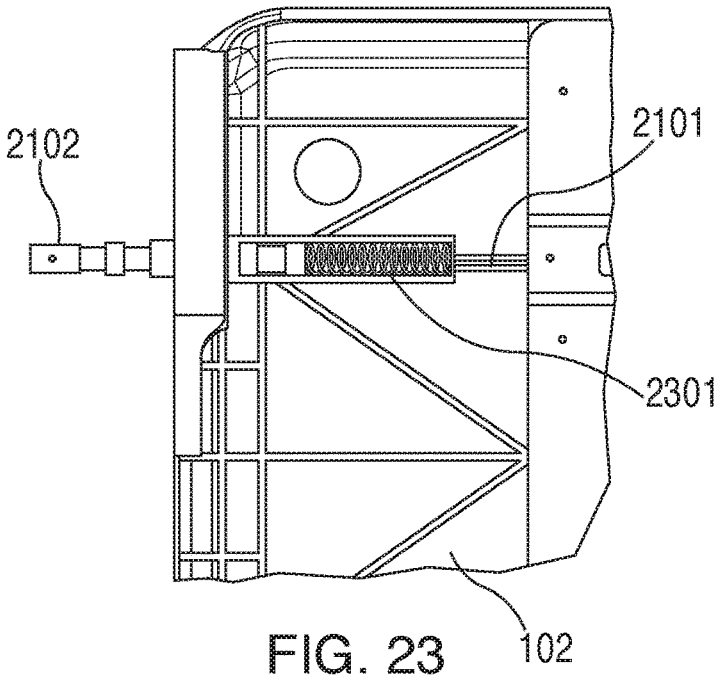
FIG. 23 comprises a detail, cutaway bottom plan view as configured in accordance with various embodiments of these teachings.

Referring now to FIG. 23 as well, a portion of the longitudinal member 2102 resides within the seat assembly 102 while another portion of the longitudinal member 2012 extends partially out of the side of the seat assembly 102 and hence extends into the aforementioned hub 101 as described in more detail below. As shown, the inwardly-disposed end of the longitudinal member 2102 connects to the aforementioned cable 2101 and hence connects to the aforementioned latch trigger 1301.

Figure 24:
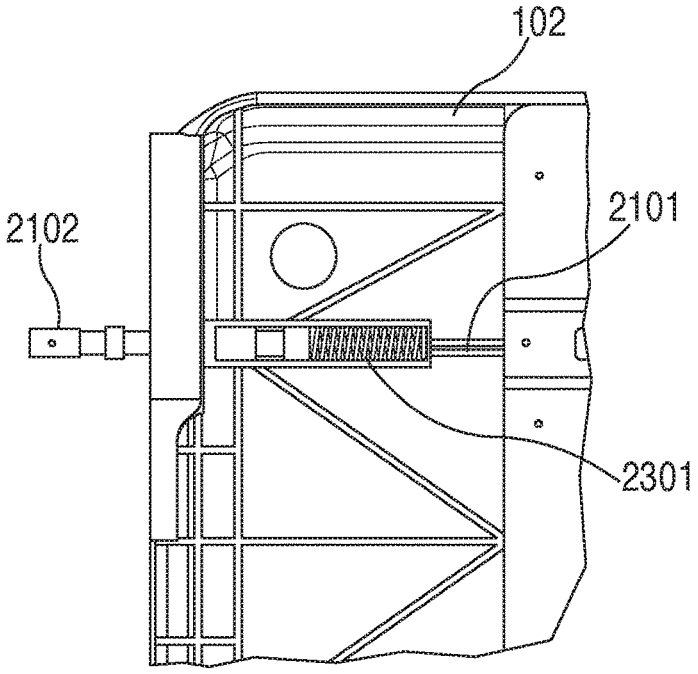
FIG. 24 comprises a detail, cutaway bottom plan view as configured in accordance with various embodiments of these teachings.

FIG. 23 presents these components while the latch trigger 1301 is unasserted. A spring 2301 serves to normally bias each longitudinal member 2102 outwardly and away from the seat assembly 102. Upon asserting the latch trigger 1301, however, and as shown in FIG. 24, the cable 2101 pulls the longitudinal member 2102 further inwardly of the seat assembly 102 for so long as the latch trigger 1301 is so asserted. In this example the longitudinal member 2102 is not fully withdrawn inside the seat assembly 102 but the relative positioning of the aforementioned wider-diameter areas 2201 and smaller-diameter areas 2202 is axially altered. This shifting of these areas 2201 and 2202 unlocks at least two of the aforementioned sub-hubs and permits corresponding rotation of those sub-hubs.

For the sake of clarity and an illustrative example, and referring momentarily to FIG. 7, each of the aforementioned hubs 101 shown here comprises three sub-hubs. Each of these sub-hubs is more-or-less disk shaped and all three of these sub-hubs have a substantially identical outer diameter (within, say, 5 percent or 1 percent of one another). Also, all three sub-hubs are aligned coaxially with one another.

The outermost sub-hub 701 connects to a corresponding one of the wheel-bearing rear legs 103, the middle sub-hub 701 connects to a corresponding one of the handle arms 105, and the innermost sub-hub 703 connects to a corresponding one of the wheel-bearing front legs 104. Per this example, outward positioning of the longitudinal member 2102 locks the middle and innermost sub-hubs 702 and 703 with respect to the outermost sub-hub 701 and thereby maintains the roller walker 100 in the collapsed state. Moving the longitudinal member 2102 sufficiently inward, however, unlocks the middle and innermost sub-hubs 702 and 703 and permits these two sub-hubs 702 and 703 and their corresponding appendages (i.e., a handle arm 105 and a front leg 104, respectively) to rotate with respect to the outermost sub-hub 701 and the rear leg 103 to thereby unfold the rolling walker 100 to a fully deployed state.

Figure 25:
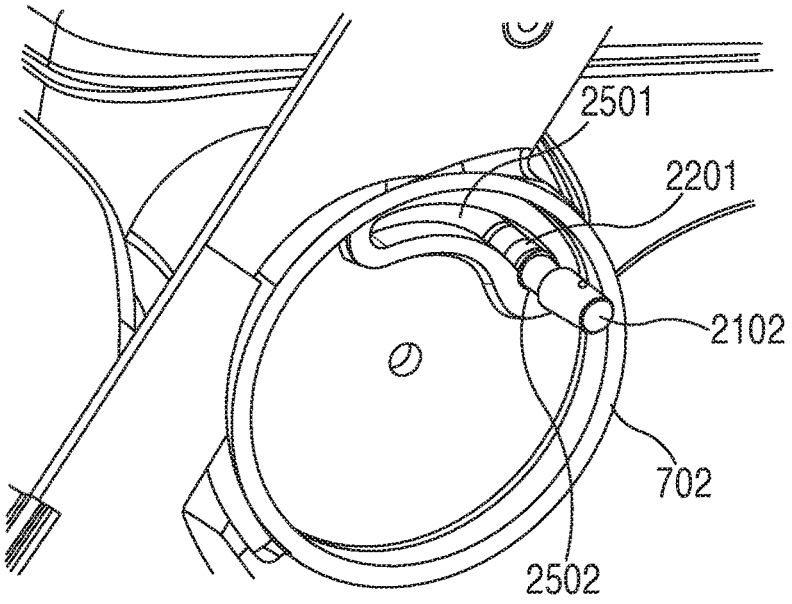
FIG. 25 comprises a detail perspective view as configured in accordance with various embodiments of these teachings.

FIG. 25 presents a detailed view of the middle sub-hub 702. Both this middle sub-hub 702 and the innermost sub-hub 703 have an off-center arcuate slot 2501 formed therethrough. In this example the arcuate slot 2501 is disposed near the outer periphery of the sub-hub. This arcuate slot 2501 includes, at one end thereof, a circular-shaped opening 2502 (perhaps most easily perceived in FIG. 27) that is wider in diameter than the cross-sectional width of the arcuate slot 2501. By one approach, and as shown, the periphery of the arcuate slot 2501 comprises a lip that is thicker than the remaining part of the sub-hub surface through which the arcuate slot 2501 extends.

This circular-shaped opening 2502 is sized to receive at least one of the wider-diameter areas 2201 of the longitudinal member 2102. By one approach this does not constitute a snug fit such that there will not be considerable friction between these two components, but the fit will nevertheless be substantially conformal such that the longitudinal member 2012 does not have much room to move in a radial direction. The cross-sectional width of the arcuate slot 2501, on the other hand, is sized smaller than the diameter of the wider-diameter areas 2201 but is sized to receive a corresponding one of the smaller-diameter areas 2202 of the longitudinal member 2102.

Figure 26:
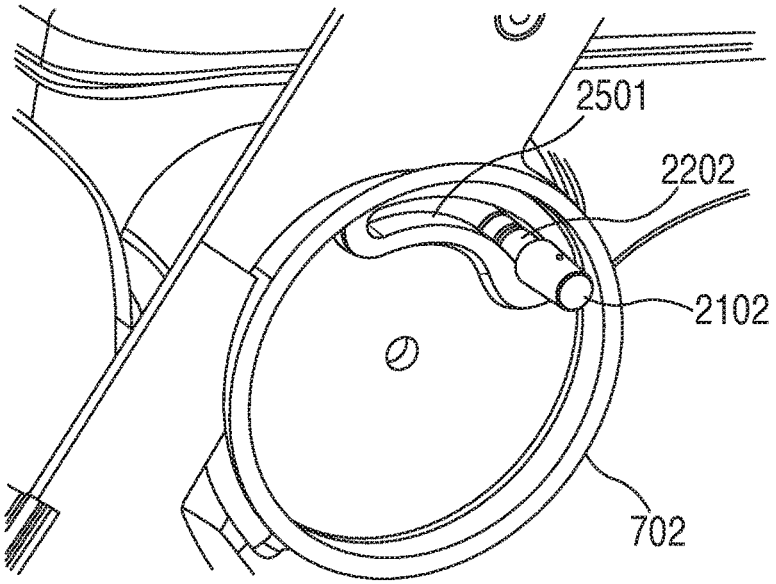
FIG. 26 comprises a detail perspective view as configured in accordance with various embodiments of these teachings.

So configured, when the longitudinal member 2102 is positioned as shown in FIG. 25, the middle sub-hub 702 is prevented from rotating about its axis (i.e., with respect to the seat assembly 102 and/or the outermost sub-hub 701) because the wider-diameter area 2201 of the longitudinal member 2102 cannot move into the arcuate slot 2501. Upon asserting the latch trigger 1301 and causing the longitudinal member 2102 to partially withdraw into the seat assembly 102, however, and as shown in FIG. 26, a smaller-diameter area 2202 of the longitudinal member 2102 becomes coincident with the arcuate slot 2501.

Figure 27:
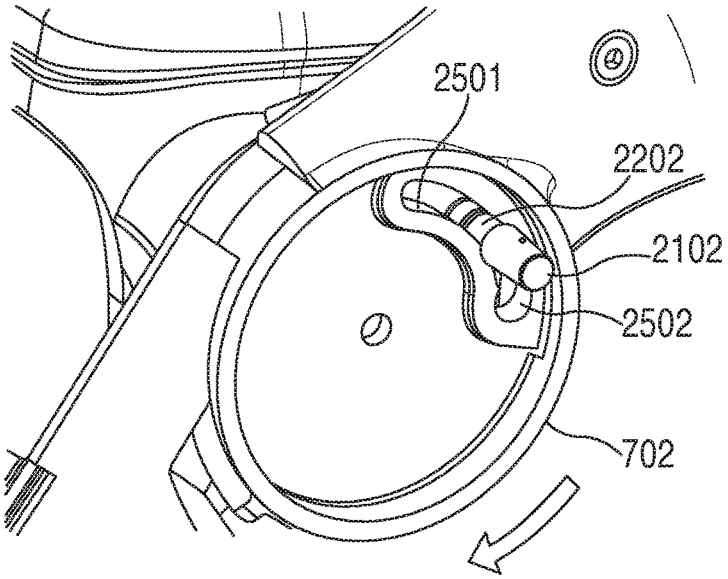
FIG. 27 comprises a detail perspective view as configured in accordance with various embodiments of these teachings.

As a result, and as shown in FIG. 27, the middle sub-hub 702 is now able to rotate about its central axis and with respect to the first sub-hub 701 (such that the handle arm 105 now also rotates with respect to the rear leg 103). This rotation can continue up to but not beyond when the longitudinal member 2102 abuts the end of the arcuate slot 2501 that is opposite the circular-shaped opening 2502.

The third sub-hub 703 is similarly configured and interacts in an identical manner with the longitudinal member 2102 to thereby permit the third sub-hub 703 to rotate with respect to the first sub-hub 701 and to thereby permit the front leg 104 to rotate with respect to the rear leg 103.

Figure 14:
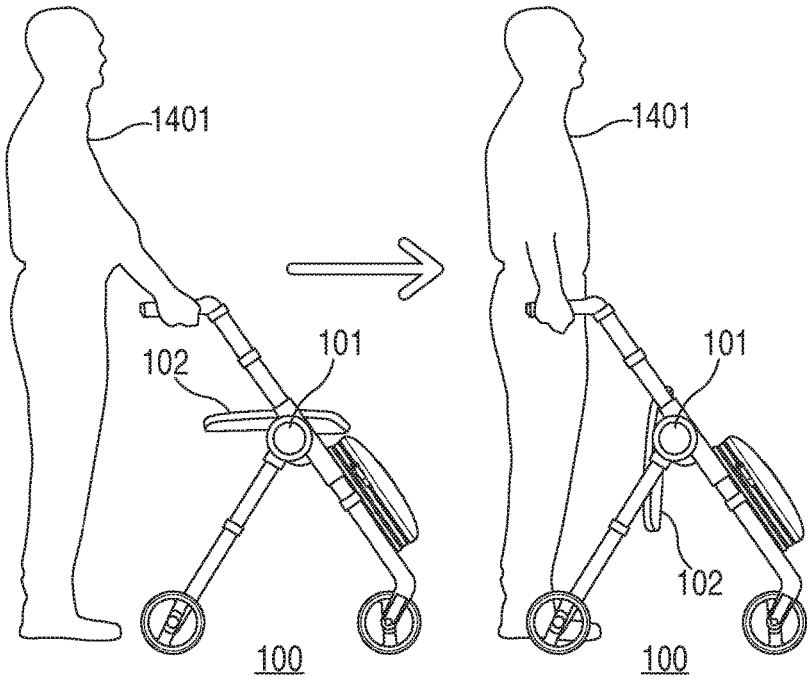
FIG. 14 comprises a side elevational view as configured in accordance with various embodiments of these teachings.

By one approach, and as illustrated in FIG. 14, the seat assembly 102 can selectively pivot about the hub 101 axis. As shown on the left, the seat assembly 102 is disposed horizontally and can, in this orientation, readily accommodate a seated person. As shown on the right, the seat assembly 102 is pivoted downwardly into a substantially vertical orientation. In this state a person 1401 using the rolling walker 100 can be closer to the rolling walker 100 when walking with the apparatus.

By one approach the seat assembly 102 is latched when in the horizontal orientation. A latch trigger can then be asserted to unlatch the seat assembly 102 to permit the pivoting described above. By one approach the aforementioned latch trigger 1301 that comprises a part of the seat assembly 102 can also serve in these regards. By one approach, for example, this latch trigger 1301 can have an intermediate state that serves to unlatch the seat assembly 102. Fully asserting the latch trigger 1301 can serve to unlatch the front legs 104 and handle arms 105 as described above.

Figure 15:
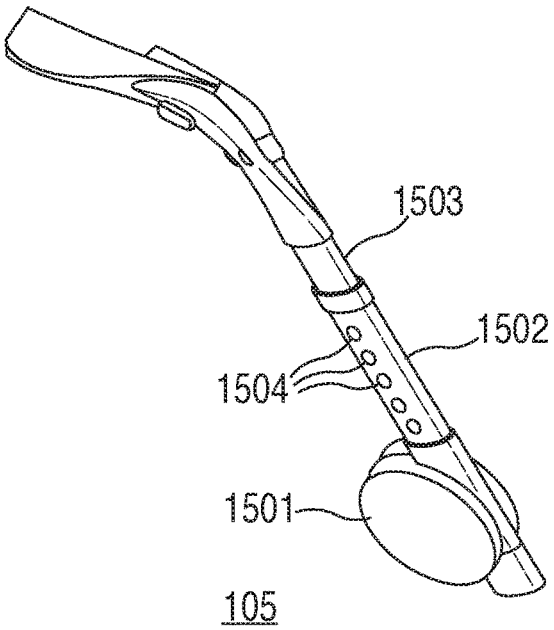
FIG. 15 comprises a perspective view as configured in accordance with various embodiments of these teachings.

FIG. 15 depicts one illustrative example for the aforementioned handle arms 105. The handle arm 105 includes a disk-shaped assembly 1501 that comprises a part of the aforementioned hub 101. The handle arm 105 includes an outer sleeve 1502 and an inner tube 1503 that slides selectively within the outer sleeve 1502. The outer sleeve 1502 includes a plurality of holes 1504 such that a spring-biased button that comprises a part of the inner tube 1503 will register with one of the holes 1504 and thereby hold the respective positions of the outer sleeve 1502 and the inner tube 1503. So configured the height of the handle arm 105 can be readily adjusted to accommodate a particular user.

The length of the handle arm 105 can also be readily shortened to help yield a smaller overall form factor for the rolling walker 100 when in the collapsed state.

Figure 16:
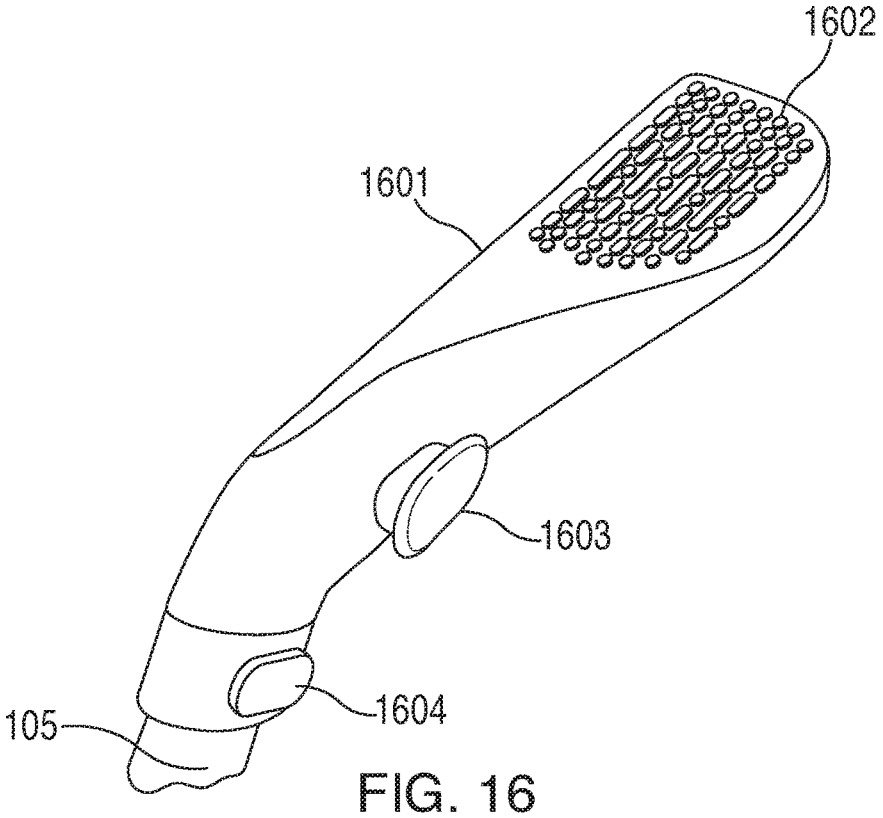
FIG. 16 comprises a perspective view as configured in accordance with various embodiments of these teachings.

FIG. 16 depicts one example of a handle 1601 that is disposed at the upper end of the handle arm 105. This handle 1601 includes a large horizontal textured area 1602 to thereby provide a large support area for the user's hand. In particular, a user can effectively rest (or press) their hand upon this textured area 1602 without necessarily gripping the handle 1601 if desired. This handle 1601 can be comprised of a relatively soft material (though nevertheless firm enough to suit the needs of a typical application setting) to provide shock absorption during use.

The handle 1601 in this illustrative example also includes a lock button 1603. Manipulating this lock button 1603 allows the user to lock and unlock a corresponding wheel to thereby control whether the rolling walker 100 can be readily rolled or not.

In this example the handle 1601 also includes a handle lock button 1604. This button 1604 can be manipulated to control whether the handle 1601 is in a deployed position or in an undeployed position (as shown in FIG. 8) to facilitate providing a low profile when collapsed.

Figure 17:
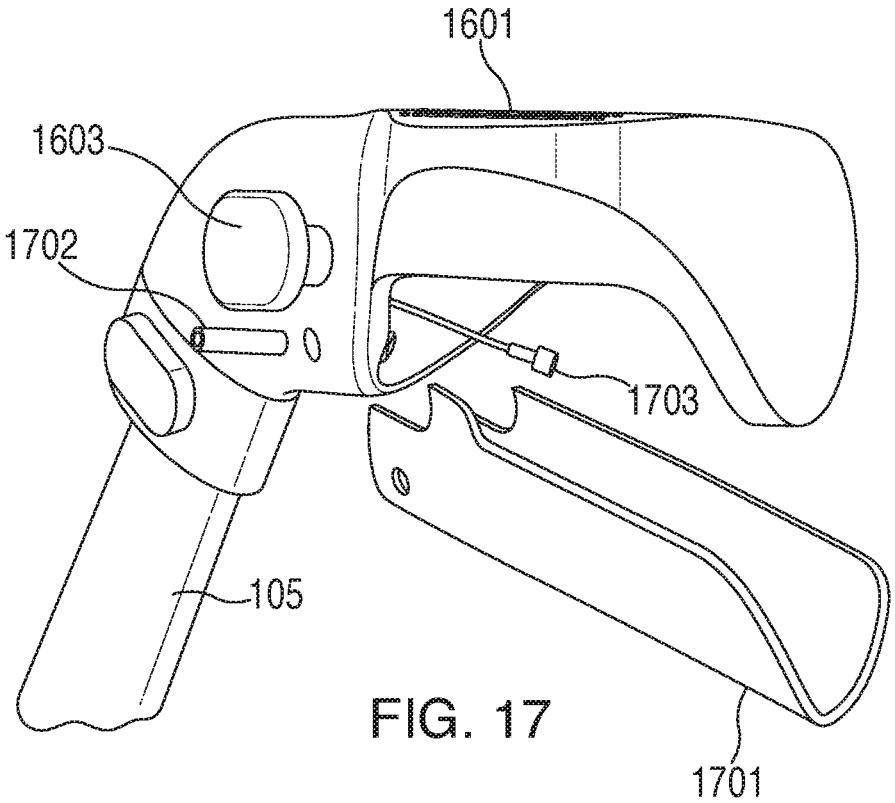
FIG. 17 comprises a perspective view as configured in accordance with various embodiments of these teachings.

Also in this example, the handle 1601 includes a brake handle 1701 as shown in FIG. 17. This brake handle 1701 pivotally connects to the handle 1601 via a corresponding pin 1702. The brake handle 1701 is secured to the end of a brake cable 1703. So configured, the brake handle 1701 can be manipulated (in this example, by squeezing the brake handle 1701 upwardly towards the handle 1601) to thereby act upon the brake cable 1703 in a way that causes a wheel brake mechanism (described further below) to act upon a corresponding wheel to thereby effect a braking action.

Figure 28:
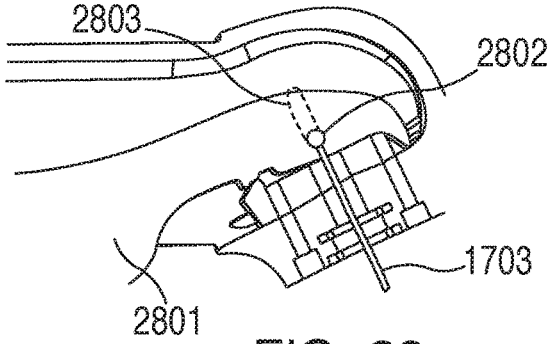
FIG. 28 comprises a detail, cutaway side-elevational view as configured in accordance with various embodiments of these teachings.

The present teachings are highly flexible in these regards and will accommodate other approaches for the brake handle. FIG. 28 presents an illustrative example in these regards. In this example, a hand-manipulable brake handle 2801 ordinarily extends outwardly of the handle assembly at an angle suitable to accommodate the expectations of a particular application setting. One end 2801 of the brake cable 1703 connects to the brake handle 2801 and is able to move within a track 2803 in the handle assembly.

Figure 29:
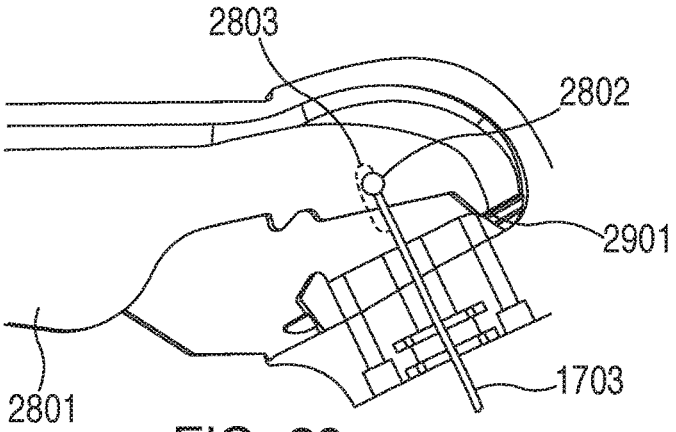
FIG. 29 comprises a detail, cutaway side-elevational view as configured in accordance with various embodiments of these teachings.
Figure 30:
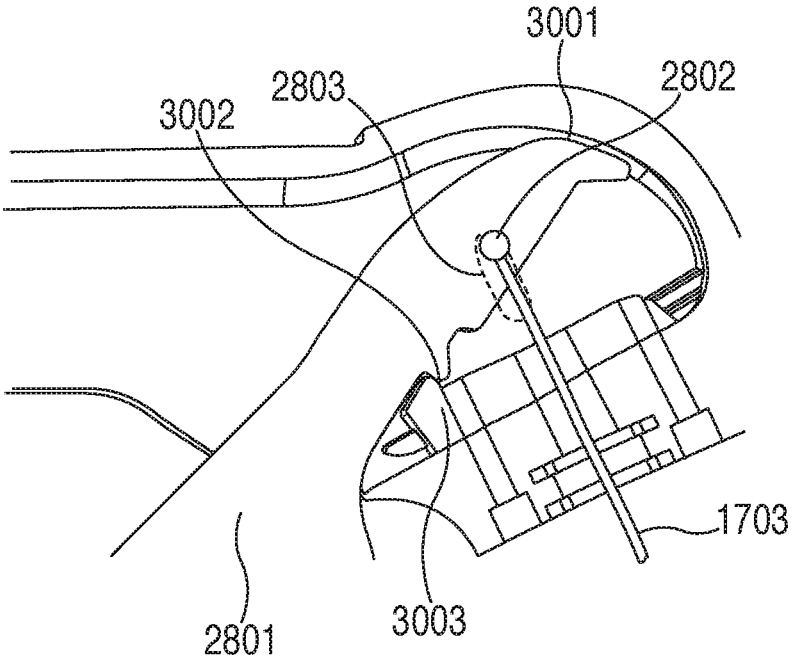
FIG. 30 comprises a detail, cutaway side-elevational view as configured in accordance with various embodiments of these teachings.

By hand squeezing the brake handle 2801 towards the handle assembly as shown in FIG. 29, the tip 2901 of the brake handle 2801 serves as a pivot point and the end 2801 of the brake cable 1703 moves upwardly in the aforementioned track 2803 and thereby actuates a braking mechanism (for example, as described above). Upon releasing the brake handle 2801 the end 2801 of the brake cable 1703 returns to the at-rest position shown in FIG. 28 and the braking mechanism disengages to again permit the wheels to turn freely.

The illustrated configured will also serve as a parking brake to permit the braking mechanism to be engaged even after the user releases the brake handle 2801. In particular, as the user presses downwardly on the brake handle 2801, a surface 3001 at the end of the brake handle 2801 comes into contact with a conformally-accommodating surface on the interior of the handle assembly. At the same time a latch surface 3002 engages a corresponding feature 3003 within the handle assembly.

Together, these components serve to latch and secure the brake handle 2801 in the illustrated position. So disposed, the end 2802 of the brake cable 1703 is again moved upwardly along the aforementioned track 2803 to again place tension on the brake cable 1703 and thereby engage the brake mechanism. Being latched in place, the brake handle 2801 will remain in this orientation (and hence the brakes will remain engaged) until the user squeezes the brake handle 2801 back towards its ordinary at-rest position to overcome the forces that were holding the brake handle 2801 in the latched position. Upon returning to the at-rest position, the tension on the brake cable 1703 is released and the braking mechanism is disengaged.

It will be appreciated that these teachings not only provide for concealing the brake cable 1703 within the framework of the rolling walker 100, but also provide for concealing the user-interface end of the brake cable 1703. The result is both aesthetically pleasing and serves to protect the brake cable connection point as well.

Figure 18:
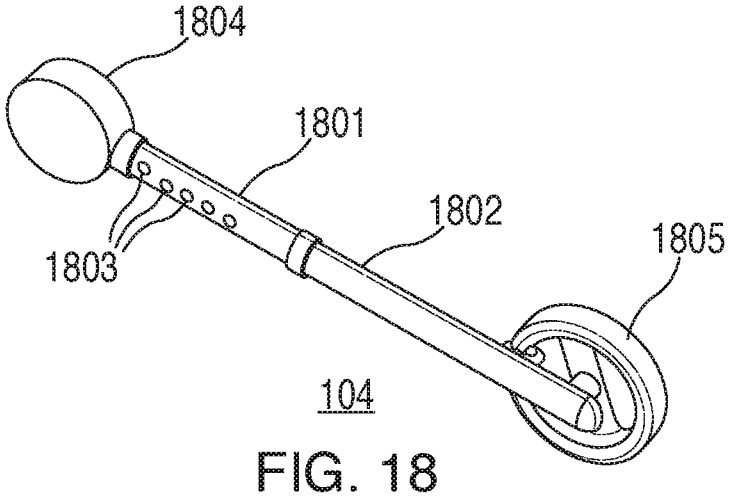
FIG. 18 comprises a perspective view as configured in accordance with various embodiments of these teachings.

FIG. 18 presents a view of one example of a rear leg 103. Like the handle arm 105, the rear leg 103 includes an outer sleeve 1801 and an inner tube 1802 that can slide back and forth within the outer sleeve 1801. And again the outer sleeve 1801 includes a plurality of axially-aligned holes 1803, any one of which can receive a spring-biased button on the inner tube 1802 to thereby lock the respective positions of the inner tube 1802 and the outer sleeve 1801. The latter mechanism again facilitates adjusting the general dimensions of the rolling walker 100 to suit the requirements of a given user.

The outer sleeve 1801 of the rear leg 103 connects to a disk-shaped component 1804 that comprises a part of the aforementioned hub 101.

A wheel 1805 connects via an axle to the opposing end of the rear leg 103. As perhaps better shown in FIG. 19, this wheel 1805 has a single spoke 1901. This spoke 1901 is disposed towards the outer side of the wheel 1805 and hence does not block or otherwise interfere with the interior rim of the wheel 1805.

Figure 19:
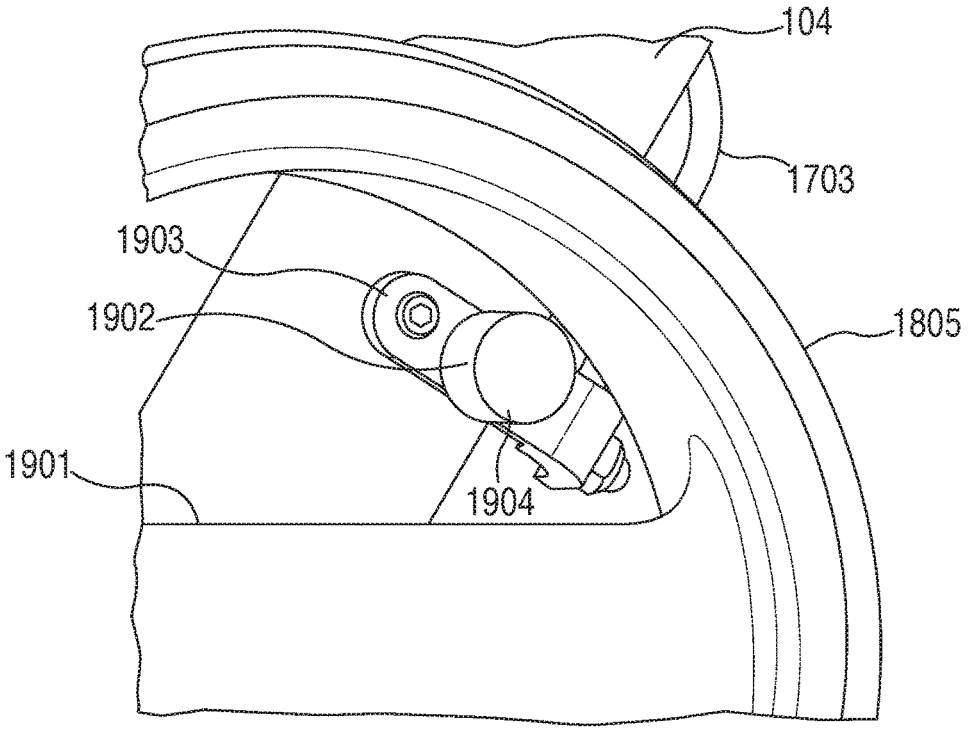
FIG. 19 comprises a detail perspective view as configured in accordance with various embodiments of these teachings.

FIG. 19 also depicts a brake mechanism 1902. This brake mechanism 1902 includes an arm 1903 that pivotally connects at one end to the front leg 104. The outer end of the arm 1903 connects to one end of the brake cable 1703 that connects to the brake handles described above. The brake mechanism 1902 also includes a brake disc 1904 that connects to the arm 1903. This brake disc 1904 can be formed of a suitable material such as rubber. So configured, appropriate manipulation of the brake cable 1703 (in particular, in this example, by squeezing the aforementioned brake handle 1701) causes the brake disc 1904 to engage the interior rim of the wheel 1805. The resulting friction slows and/or prevents further rotation of the wheel 1805.

By one approach, and as illustrated here, the aforementioned brake cable 1703 is largely contained and routed through the interior of the respective handle arm 105 and rear leg 103. So disposed the brake cable 1703 is protected from external influences (for example, from accidentally snagging on nearby objects). Concealing the brake cable 1703 can also contribute to an aesthetically pleasing design.

As illustrated here, both of the rear legs 103 have a brake mechanism 1902 as described above. The above-described processes are readily enabled using any of a wide variety of available and/or readily configured platforms, including partially or wholly programmable platforms as are known in the art or dedicated purpose platforms as may be desired for some applications.

Referring again to FIGS. 1 and 2, in this illustrative example the front leg 104 terminates in its lower end with an end piece that aims back rearwardly (in this example, at an angle that substantially parallels the orientation of the rear leg 103). This end piece, angled in this fashion, yields an aesthetically pleasing result and also helps to shorten the wheelbase, thereby helping to achieve a more compact footprint in both the collapsed and uncollapsed states.

Figure 20:
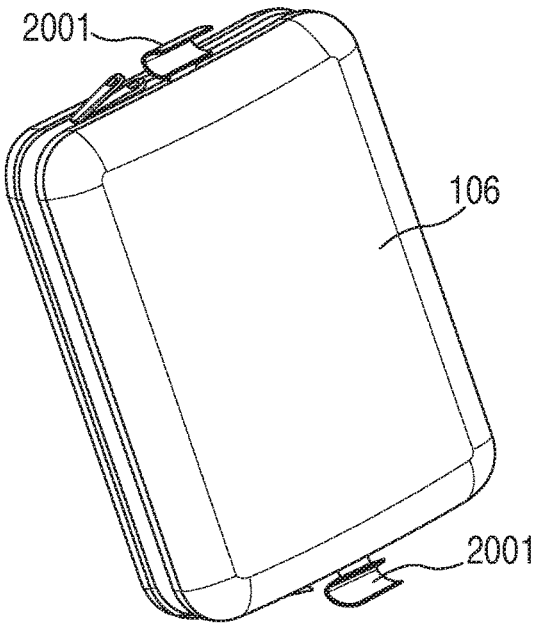
FIG. 20 comprises a perspective view as configured in accordance with various embodiments of these teachings.

Those skilled in the art will recognize that a wide variety of modifications, alterations, and combinations can be made with respect to the above described embodiments without departing from the scope of the invention. As but one example in these regards, and referring again to FIG. 1, a bag 106 can be disposed on the front of the rolling walker 100. In this example the bag 106 has soft, but firm, plastic sides. Such a bag 106 can have, for example, one or more open pockets and/or zippered pockets to provide spaces for a user to store various items such as keys, a purse, a portable phone, and so forth. By one approach, and as illustrated in FIG. 9, the bag 106 can be selectively removable from and attachable to the front legs 104 of the rolling walker 100. To facilitate this capability, and as illustrated in FIG. 20, opposing sides of the bag 106 can include a plastic clip 2001 configured to securely clip to a respective one of the front legs 104. So configured the bag 106 can be readily removed from the rolling walker 100 and attached thereto as desired during use.

Accordingly, it will be understood that such modifications, alterations, and combinations are to be viewed as being within the ambit of the inventive concept.

What is claimed is:

1. A rolling walker comprising:

a seat assembly;

a pair of hubs disposed on opposing sides of the seat assembly, each of the hubs comprising at least three sub-hubs wherein at least two of the sub-hubs for each of the hubs comprise rotatable sub-hubs that are configured to selectively rotate with respect to a non-rotating one of the sub-hubs;

a plurality of legs that are each secured to corresponding ones of the sub-hubs, wherein the sub-hubs that comprise the non-rotating sub-hubs are directly affixed to some, but not all, of the plurality of legs;

a plurality of handle arms that are each secured to corresponding ones of the sub-hubs;

such that the legs and the handle arms can be selectively rotated with respect to one another between a fully-collapsed state and a fully-deployed state.

2. The rolling walker of claim 1 wherein the sub-hubs share a same external shape and cross-sectional size.

3. The rolling walker of claim 2 wherein the external shape comprises a disk.

4. The rolling walker of claim 3 wherein each of the sub-hubs has a disk cross-sectional diameter that is within 5 percent of one another.

5. The rolling walker of claim 3 wherein the sub-hubs for each of the hubs are coaxially aligned such that the hub also has a disk-shaped external shape.

6. The rolling walker of claim 1 wherein each of the sub-hubs secures to one, and only one, of the plurality of legs and handle arms.

7. The rolling walker of claim 1 wherein the legs that directly secure to the non-rotating sub-hubs are rear legs for the rolling walker.

8. The rolling walker of claim 1 wherein the legs and the handle arms are disposed at least within 5 degrees of one another when in the fully-collapsed state.

9. The rolling walker of claim 8 wherein the legs and the handle arms are disposed at least within 2 degrees of one another when in the fully-collapsed state.

10. The rolling walker of claim 1 wherein the seat assembly includes integral flanges that each comprise a part of one of the sub-hubs.

11. The rolling walker of claim 1 wherein the hubs share a common central axis.

12. The rolling walker of claim 11 wherein the seat assembly is configured to selectively pivot about the common central axis.

13. The rolling walker of claim 12 wherein the seat assembly is configured to selectively pivot about the common central axis even when the plurality of legs and handle arms are disposed in the fully-deployed state.

14. The rolling walker of claim 13 wherein the seat assembly is configured to selectively pivot about the common central axis between a horizontal position and a vertical position when the plurality of legs and handle arms are disposed in the fully-deployed state.

15. The rolling walker of claim 1 wherein each of the handle arms integrally includes a part of the sub-hub to which the handle arm is respectively secured.

16. The rolling walker of claim 15 wherein at least some of the plurality of legs each integrally includes a part of the sub-hub to which the leg is respectively secured.

* * * * *